US008978200B2

(12) United States Patent
Lenkiewicz et al.

(10) Patent No.: US 8,978,200 B2
(45) Date of Patent: Mar. 17, 2015

(54) VACUUM CLEANER WITH LATCH MECHANISM

(75) Inventors: Kenneth M. Lenkiewicz, Grand Rapids, MI (US); Bruce Xue, ShanXi (CN)

(73) Assignee: BISSELL Homecare, Inc., Grand Rapids, MI (US)

( * ) Notice: Subject to any disclaimer, the term of this patent is extended or adjusted under 35 U.S.C. 154(b) by 833 days.

(21) Appl. No.: 13/190,997

(22) Filed: Jul. 26, 2011

(65) Prior Publication Data

US 2012/0023701 A1 Feb. 2, 2012

Related U.S. Application Data

(60) Provisional application No. 61/368,098, filed on Jul. 27, 2010.

(51) Int. Cl.
*A47L 9/16* (2006.01)

(52) U.S. Cl.
CPC ..... *A47L 9/1691* (2013.01); *A47L 9/1666* (2013.01); *Y10S 55/03* (2013.01)
USPC ..... 15/352; 15/353; 55/337; 55/429; 55/DIG. 3

(58) Field of Classification Search
USPC ..... 15/353; 55/337, 429, DIG. 3
IPC ..... A47L 9/16; B01D 45/18
See application file for complete search history.

(56) References Cited

U.S. PATENT DOCUMENTS

| | | | | |
|---|---|---|---|---|
| 6,732,406 | B2 | 5/2004 | Oh | |
| 6,735,816 | B2 | 5/2004 | Oh et al. | |
| 6,782,584 | B2 | 8/2004 | Choi | |
| 6,896,719 | B2 | 5/2005 | Coates et al. | |
| 6,922,868 | B1 | 8/2005 | Jeong | |
| 6,991,667 | B2 | 1/2006 | Yang et al. | |
| 7,305,735 | B2 | 12/2007 | Overvaag | |
| 7,544,224 | B2 | 6/2009 | Tanner et al. | |
| 7,556,662 | B2 | 7/2009 | Lee et al. | |
| 7,836,546 | B2 * | 11/2010 | Yoo et al. | 15/352 |
| 2002/0088079 | A1 | 7/2002 | Oh | |
| 2007/0011842 | A1 | 1/2007 | Moon | |
| 2009/0056290 | A1 | 3/2009 | Oh et al. | |

FOREIGN PATENT DOCUMENTS

| | | | |
|---|---|---|---|
| GB | 2449349 | A | 11/2008 |

OTHER PUBLICATIONS

Martin Gonzalez, G, European Search Report, Sep. 13, 2012, 2 pages, Munich.

* cited by examiner

*Primary Examiner* — David Redding
(74) *Attorney, Agent, or Firm* — McGarry Bair PC

(57) ABSTRACT

A latch mechanism for a dirt cup of a vacuum cleaner. The latch mechanism can include a first sloped portion provided on a mounting structure for receiving a dirt cup and a filter housing in supporting relationship to the vacuum cleaner and a second sloped portion on the filter housing corresponding to the first sloped portion. Movement of the filter housing in a first direction relative to the mounting structure as the first and second sloped portions bear against each other results in the movement of the filter housing, and thus the dirt cup, in a second direction transverse to the first direction relative to the mounting structure.

20 Claims, 7 Drawing Sheets

VACUUM CLEANER WITH LATCH MECHANISM

CROSS-REFERENCE TO RELATED APPLICATION

This application claims the benefit of U.S. Provisional Application No. 61/368,098, filed Jul. 27, 2010, which is incorporated herein by reference in its entirety.

BACKGROUND OF THE INVENTION

Vacuum cleaners can use a removable dirt cup to store collected dirt, dust and other contaminates for later disposal. The dirt cup can have a latch mechanism that selectively secures the dirt cup to the vacuum cleaner in a position to receive dirt, dust, and other contaminates. The latch mechanism also allows the dirt cup to be selectively removed from the vacuum cleaner to be emptied. Conventional latch mechanisms fasten only the dirt cup to the vacuum cleaner.

Some known latch mechanisms directly engage the dirt cup and require vertical movement of the dirt cup in order to secure or remove the dirt cup relative to the vacuum cleaner. For example, such latch mechanisms directly engage a bottom of the dirt cup to raise the dirt cup to secure it to the vacuum cleaner and lower the dirt cup to remove it from the vacuum cleaner. Examples of such latch mechanisms include: U.S. Pat. No. 6,732,406 to Oh, issued May 11, 2004; U.S. Pat. No. 6,735,816 to Oh et al., issued May 18, 2004; U.S. Pat. No. 6,782,584 to Choi, issued Aug. 31, 2004; and U.S. Pat. No. 6,922,868 to Jeong, issued Aug. 2, 2005. Other latch mechanisms indirectly engage the dirt cup to selectively raise or lower the dirt cup. One example of such a latch mechanism is shown in U.S. Pat. No. 6,991,667 to Yang et al., issued Jan. 31, 2006.

BRIEF DESCRIPTION OF THE INVENTION

According to the invention, a latch mechanism for selectively fastening a dirt cup to a vacuum cleaner comprises a housing having a mounting structure for mounting a dirt cup and a filter housing, and at least one sloped projection on the mounting structure. The latch mechanism comprises a filter housing having at least one sloped surface at a position corresponding to the position of the sloped projection on the mounting structure and a top portion configured to support a dirt cup, wherein movement of the filter housing in a first direction relative to the mounting structure, with the at least one sloped surface bearing against the at least one sloped projection, results in the movement of the filter housing, and thus the dirt cup, in a second direction transverse to the first direction with respect to the mounting structure.

Further according to the invention, a vacuum cleaner comprises a housing having a mounting structure, a filter housing selectively mounted in the mounting structure, a dirt cup selectively mounted in the mounting structure and supported by the filter housing, a first sloped portion on the mounting structure in supporting relationship to the filter housing, and a second sloped portion on the filter housing corresponding to the first sloped portion, wherein the first sloped portion and the second sloped portion are configured such that movement of the filter housing in a first direction relative to the mounting structure as the first and second sloped portions bear against each other results in the movement of the filter housing and thus the dirt cup, in a second direction transverse to the first direction relative to the mounting structure.

DESCRIPTION OF EMBODIMENTS OF THE INVENTION

The invention relates to a latch mechanism for vacuum cleaners. In one of its aspects, the invention relates to a vacuum cleaner with a removably-mounted dirt cup. In another of its aspects, the invention relates to a dirt cup with an improved latch mechanism integrated with a filter assembly for removably mounting the dirt cup to a vacuum cleaner. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
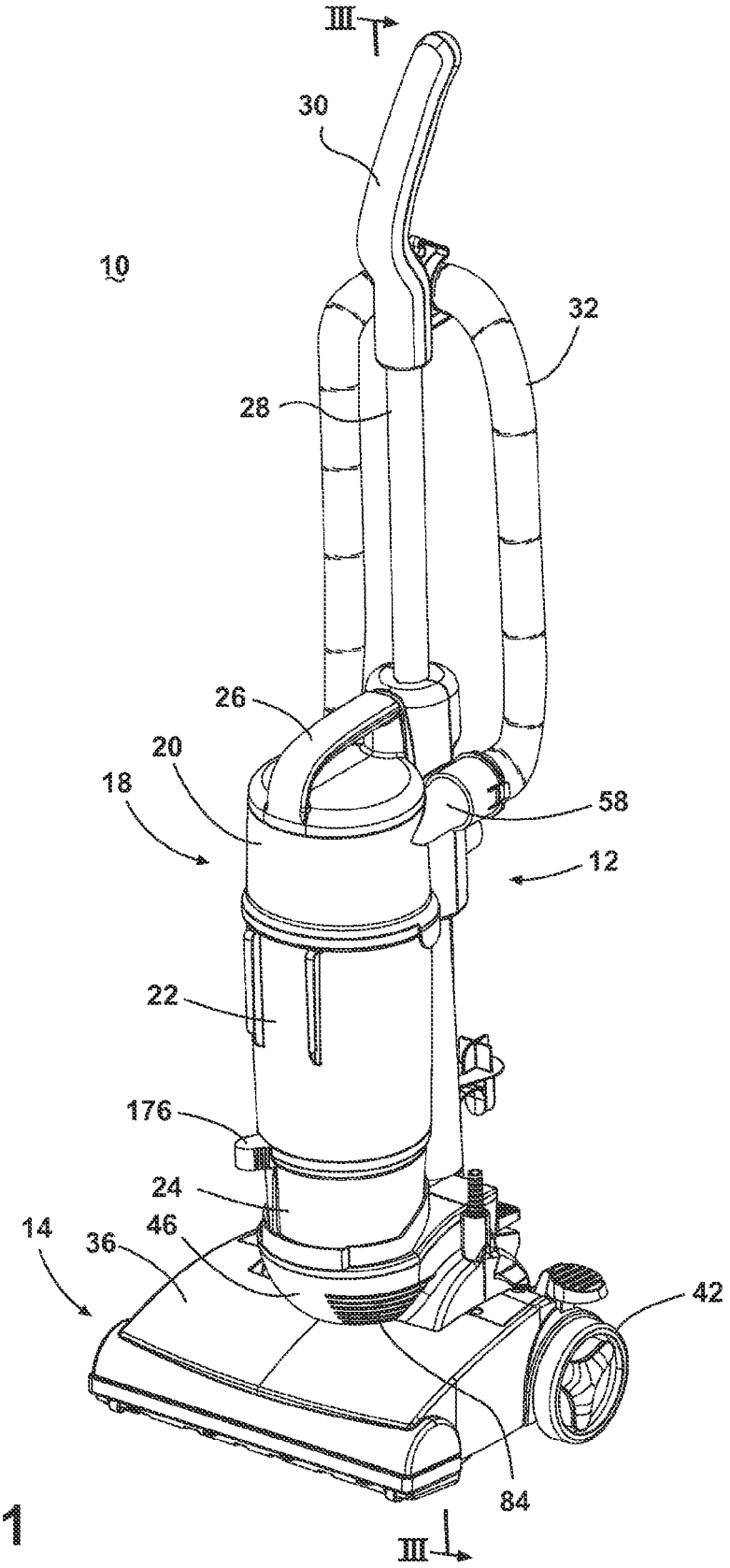
FIG. 1 is a front perspective view of a vacuum cleaner according to one embodiment of the invention with a latch mechanism in a latched position.

FIG. 1 is a front perspective view of a vacuum cleaner 10 according to one embodiment of the invention. As illustrated, the vacuum cleaner 10 comprises an upright handle assembly 12 pivotally mounted to a foot assembly 14. The upright handle assembly 12 comprises a main body 16 housing a filtration system 18 for separating contaminants from a working airstream. As illustrated, the filtration system 18 includes a bagless cyclonic filter in the form of a cyclone separator 20, a removable dirt cup 22 for receiving and collecting the separated contaminants from the cyclone separator 20, and a secondary filter assembly 24 for filtering working air downstream of the cyclone separator 20. The main body 16 also has a first hand grip 26 provided on an upper surface of the main body 16 that can be used for lifting the entire vacuum cleaner 10. A handle 28 extends upwardly from the first hand grip 26 and is provided with a second hand grip 30 at one end that can be used for maneuvering the vacuum cleaner 10 over a surface to be cleaned.

Figure 2:
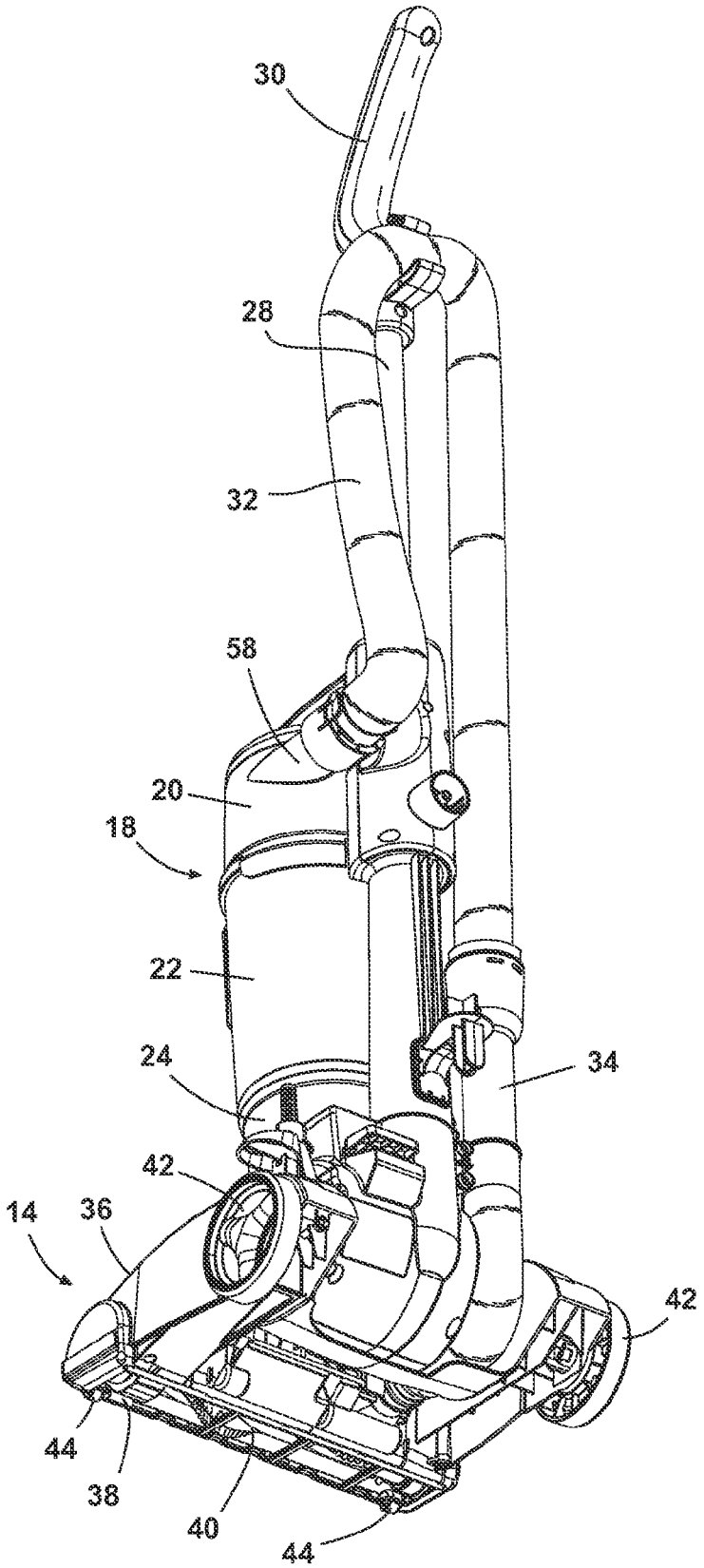
FIG. 2 is a bottom perspective view of the foot assembly of the vacuum cleaner from FIG. 1.

FIG. 2 is a rear perspective view of the vacuum cleaner 10 illustrated in FIG. 1. The handle 28 selectively supports a vacuum hose 32, which is coupled at one end to the cyclone separator 20 and at the opposite end to a removable wand 34. The wand 34 is removable from the vacuum cleaner 10 for above-the-floor cleaning; when mounting to the vacuum cleaner 10, the wand 34 is in fluid communication with the foot assembly 14.

The foot assembly 14 includes a foot assembly casing 36 having a suction nozzle opening 38 formed therein and an agitator 40 provided adjacent the suction nozzle opening 38. The agitator 40 is illustrated as a rotating brushroll; however, it is within the scope of the invention for other types of agitators to be used, such as a stationary brush or a blade-type wiper. A working air path fluidly communicates the suction nozzle opening 38 with the filtration system 18 (shown in FIG. 1); specifically, the working air path extends from the suction nozzle opening 38, through the wand 34 and vacuum hose 32, and into the cyclone separator 20. A pair of rear wheels 42 and a pair of front wheels 44 are provided on the foot assembly casing 36 for maneuvering the vacuum cleaner 10 over a surface to be cleaned.

Figure 3:
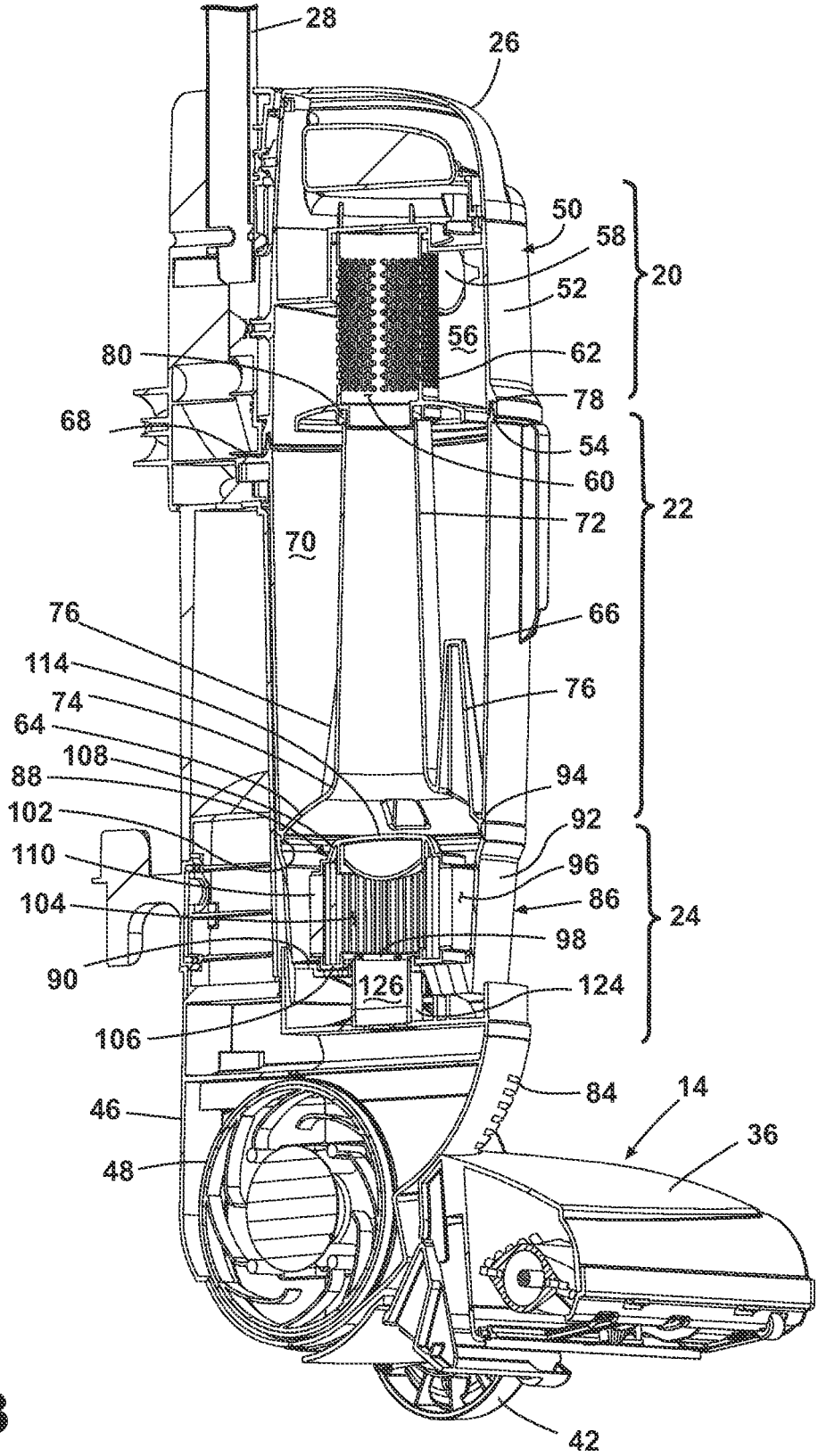
FIG. 3 is a cross-sectional view of the vacuum cleaner taken through line 3-3 of FIG. 1.

FIG. 3 is a cross-sectional view of the main body 16 taken through line 3-3 of FIG. 1. A motor cavity 46 is formed at a lower end of the main body 16 and contains a conventional suction source such as a motor/fan assembly 48 oriented transversely therein. The motor/fan assembly 48 is in fluid communication with and downstream of the cyclone separator 20.

The cyclone separator 20 includes a housing 50 having a side wall 52 with a lower edge 54 and defining a cyclonic chamber 56 having an air inlet 58 coupled with one end of the vacuum hose 32 (shown in FIG. 2) and an air outlet 60 in fluid communication with the motor/fan assembly 48. The inlet 58 can be oriented tangentially, such that the tangential airflow generated from inlet 58 is directed into the cyclonic chamber 56. A grill assembly 62 can be positioned between the cyclonic chamber 56 and the outlet 60.

The dirt cup 22 includes a bottom wall 64 with a peripheral side wall 66 extending upwardly therefrom to an upper edge 68 defining an open-topped dirt collection chamber 70. The dirt cup 22 can be substantially cylindrical, with the bottom wall 64 and the upper edge 68 both having a circular, though not necessarily equally-sized, shape. The bottom wall 64 can further include a dome-like shape, with a central portion of the bottom wall 64 being higher than a peripheral portion of the bottom wall 64.

An air outlet conduit 72 is formed with the dirt cup 22 and is in fluid communication with the outlet 60 from the cyclone separator 20. The air outlet conduit 72 extends upwardly from an opening 74 in the bottom wall 64. While the air outlet 60 is described herein as being the air outlet from the cyclone chamber 56, the opening 74 may be considered to be the air outlet from the cyclone separator 20, since the outlet 60 and opening 74 are in direct fluid communication via the air outlet conduit 72.

One or more upstanding projection(s) or finger(s) 76 protrude upwardly from the inner surface of bottom wall 64 to inhibit the vacillation of the debris deposited in the dirt cup 22, thereby disrupting the currents that would tend to carry smaller dirt particles upwardly and back into the cyclonic air flow. The fingers 76 can also deflect dirt particles within the dirt cup 22 to further encourage agglomeration of the dirt particles within the dirt cup 22. As illustrated, the fingers 76 are arranged in a spaced relationship between the side wall 66 and the air outlet conduit 72.

A first seal or gasket 78 can be provided between the lower edge 54 of the cyclone separator 20 and the upper edge 68 of the dirt cup 22 and a second seal or gasket 80 can be provided between the grill assembly 62 the cyclone separator 20 and the air outlet conduit 72 of the dirt cup 22, which forms an air-tight seal between the dirt cup 22 and the cyclone separator 20 when the dirt cup 22 is mounted to the main body 16 beneath the cyclone separator 20.

As illustrated herein, the secondary filter assembly 24 is a pre-motor filter assembly, and filters working air as it exits the cyclone separator 20 prior to entering the motor cavity 46. A tertiary filter assembly (not shown) can also be provided, and can comprise a post-motor filter assembly positioned downstream of the motor/fan assembly 48 to filter working air prior to exhausting the working air to the atmosphere through exhaust openings 84 formed in the main body 16. However, it is within the scope of the invention for the secondary filter assembly 24 to alternately comprise a post-motor filter assembly, such that the secondary filter assembly 24 is fluidly downstream of the motor/fan assembly 48.

The secondary filter assembly 24 comprises a filter housing 86 in fluid communication with the inlet to the motor/fan assembly 48 and configured to receive a removable filter member 88 for filtering working air from the cyclone separator 20 prior to entering the motor cavity 46. In the illustrated arrangement, the filter housing 86 is positioned above the motor cavity 46 and below the dirt cup 22.

The filter housing 86 includes a bottom wall 90 with a peripheral side wall 92 extending upwardly therefrom to an upper edge 94 defining an open-topped filter chamber 96. The filter housing 86 can be substantially cylindrical, with the bottom wall 90 and the upper edge 94 both having a circular, though not necessarily equally-sized, shape. The bottom wall 90 can be provided with an outlet opening 98 and filter mounting features 100 (FIG. 4) positioned on the bottom wall 90 around the outlet opening 98.

The filter housing 86 is configured to support the dirt cup 22. In the illustrated embodiment, the dirt cup 22 is supported on a top portion of the filter housing 86. More specifically, the bottom wall 64 of the dirt cup 22 rests on the upper edge 94 of the filter housing 86. At least one of the dirt cup 22 and the filter housing 86 can be formed with one or more features to facilitate a secure placement of the dirt cup 22 on the filter housing 86. As illustrated herein, the bottom wall 64 of the dirt cup 22 is provided with a peripheral lip 102 spaced slightly inwardly of juncture between the bottom wall 64 and the side wall 66. The lip 102 is received within the side wall 92 of the filter housing 86 so that the bottom wall 64 of the dirt cup 22 rests on the upper edge 94 of the filter housing 86.

The filter member 88 includes an inner filter 104 positioned between a bottom member 106 and a top member 108. An outer filter 110 is also positioned around the inner filter 104, also between the bottom member 106 and a top member 108. The bottom member 106 includes corresponding filter mounting features (not shown), which engage the filter mounting features 100 of the filter housing 86 to secure the filter member 88 within the filter housing 86. The top member 108 includes a handle 114 for facilitating the attachment or detachment of the filter member 88 within the filter housing 86. As illustrated, the inner filter 104 comprises a pleated filter, such as a HEPA-type filter, and the outer filter 110 comprises an unpleated filter, such as a sponge-type filter, although the filter assembly 24 can use other types of filters.

Figure 4:
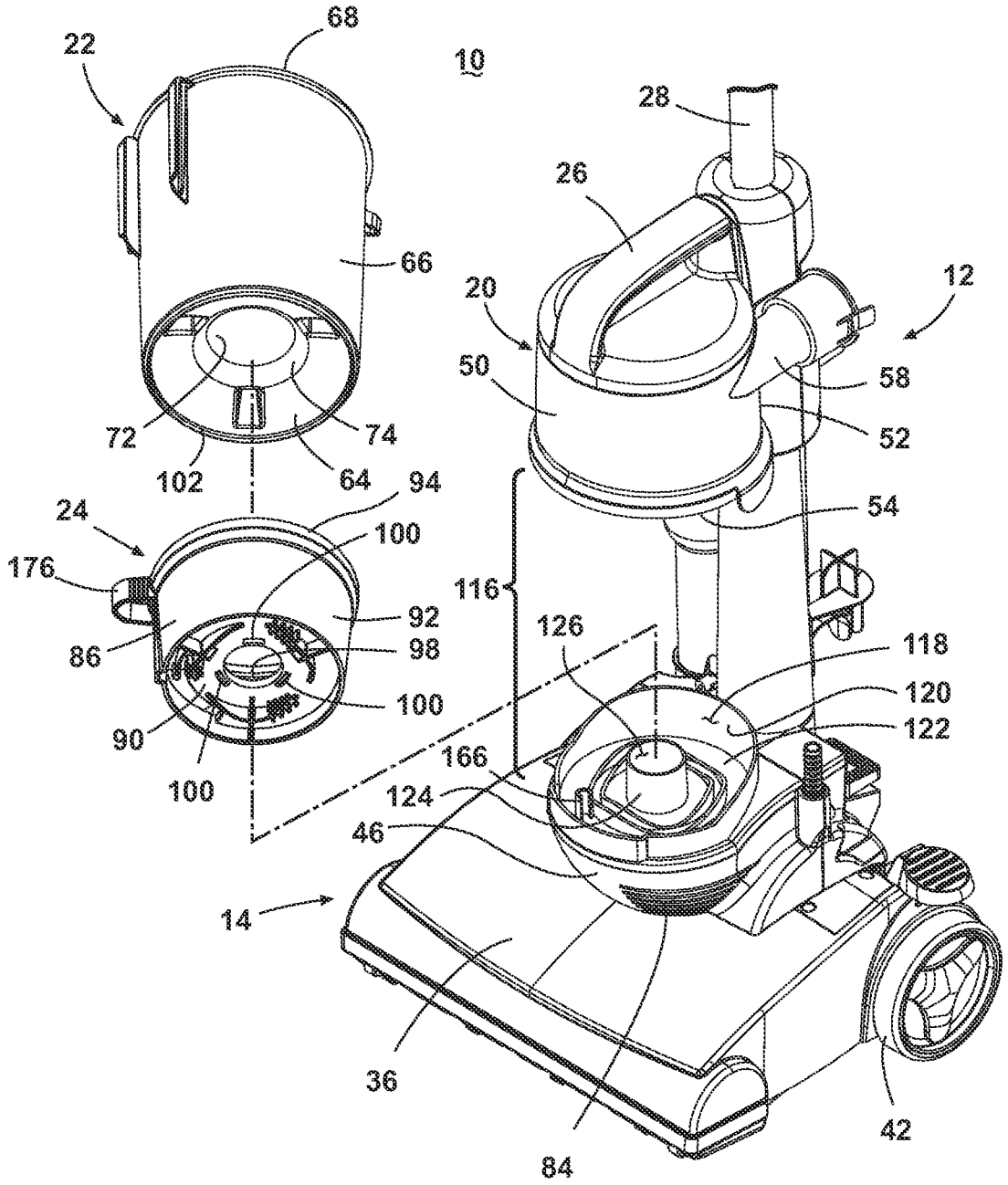
FIG. 4 is a front perspective view of the vacuum cleaner from FIG. 1, with the dirt cup shown unlatched and removed from the vacuum cleaner.

Referring to FIG. 4, in which the dirt cup 22 and the filter assembly 24 are shown removed from the vacuum cleaner 10, the main body 16 comprises a mounting structure 116 that selectively receives the dirt cup 22 and the filter assembly 24. The mounting structure 116 as illustrated herein comprises a recess 118 in a front portion of the main body 16 that includes a rear wall 120 joined to a bottom wall 122. A conduit 124 defining an inlet 126 to the motor cavity 46 extends from the bottom wall 122. While not illustrated, a filter can be provided at the inlet 126 to the motor cavity 46.

The dirt cup 22 and the filter assembly 24 are received within the recess 118 in a stacked configuration, with the filter housing 86 resting on the bottom wall 122 and the dirt cup 22 above the filter housing 86, but below the cyclone separator 20. Like both the dirt cup 22 and the filter housing 86, the recess 118 can be substantially cylindrical in shape to receive the dirt cup 22 and filter housing 86. However, it is within the scope of the invention for the dirt cup 22, filter housing 86, and recess 118 to be non-cylindrical and/or to have different shapes. When the filter assembly 24 is received by the mounting structure 116, as shown in FIG. 3, the conduit 124 is aligned with the outlet opening 98 of the filter housing 86, and the inlet 126 is in fluid communication with the outlet opening 98. In turn, the dirt cup 22 is received on top of the filter housing 86, with the air outlet conduit 72 in fluid communication with the outlet 60 of the cyclone separator 20 and with filter chamber 96 of the filter assembly 24.

In operation, the vacuum cleaner 10 draws in dirt-laden air through the foot assembly 14 and into the filtration system 18 where the dirt is substantially separated from the air. The airflow, containing particulate matter, passes through air inlet 58 and into the cyclone chamber 56 to travel around the grill assembly 62. As the airflow travels about the cyclone chamber 56, heavier dirt particles are forced toward the side wall of the housing 50. These particles fall under the force of gravity and are collected in the dirt cup 22. As the inlet air traverses through the cyclone chamber 56, casting dirt particles toward the side wall of the housing 50, the inlet air will be drawn inwardly through the grill assembly 62, which changes the velocity of the air flow, causing it to shed additional dirt particles. These dirt particles are also urged toward the dirt cup 22 by the circulating air flow in cyclone chamber 56. The air flow then passes through the outlet 60, downwardly through the air outlet conduit 72 and into the filter housing 86 where the air passes through both filters 104, 110 of the filter member 88 to remove additional fine dirt particles are from the airflow. Thereafter, the airflow continues on to the motor cavity 46, past the motor/fan assembly 48, and through the 4 exhaust openings 84.

Figure 5:
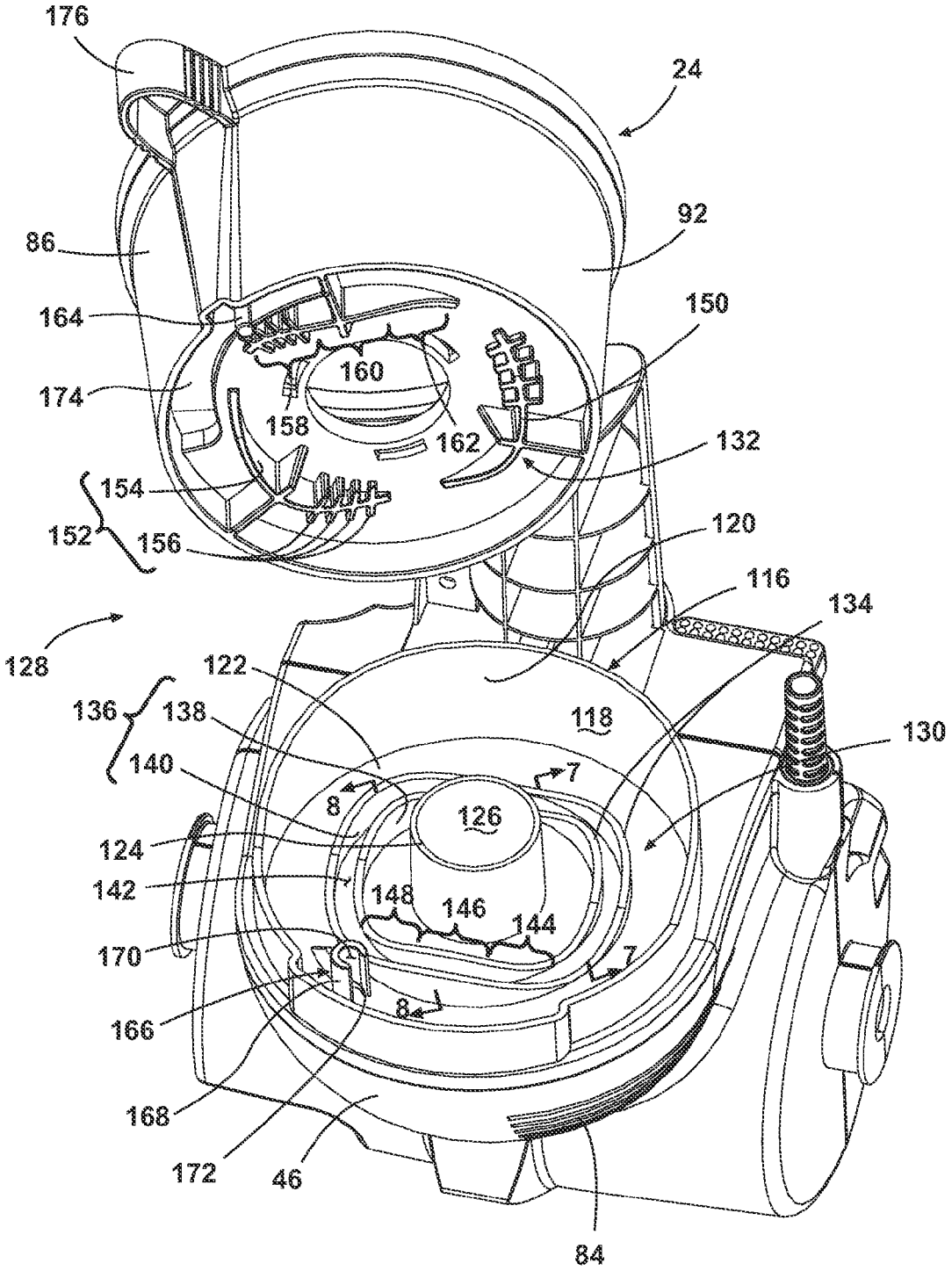
FIG. 5 is a front partial perspective view of the vacuum cleaner from FIG. 1, illustrating a latch mechanism of the vacuum cleaner.

Referring to FIG. 5, a latch mechanism 128 is provided for selectively latching the dirt cup 22 to the main body 16. The latch mechanism 128 can be integrated with the filter assembly 24, whereby a portion of the filter assembly 24 is moved to latch or unlatch the dirt cup 22 to or from the main body 16. As such, the filter assembly 24 acts as an actuator for the latch mechanism 128. As illustrated herein, the latch mechanism 128 includes both the mounting structure 116 and the filter housing 86, wherein movement of the filter housing 86 relative to the mounting structure 116 causes the filter housing 86, and thus the dirt cup 22, to move upwardly and downwardly with respect to the mounting structure 16. Upward movement of the filter housing 86 effects the latching of the dirt cup 22 to the main body 16, while downward movement of the filter housing 86 effects the unlatching of the dirt cup 22 from the main body 16.

To facilitate the movement of the filter housing 86 relative to the mounting structure 116, a first sloped portion 130 is provided on the mounting structure 116 and a second sloped portion 132 is provided on the filter housing 86 which corresponds to the first sloped portion 130. Movement of the filter housing 86 relative to the mounting structure 116 causes the first and second sloped portions 130, 132 to bear against each other, thereby causing the filter housing 86, and thus the dirt cup 22, to move upwardly and downwardly, as will be described in greater detail below.

The first sloped portion 130 provided on the mounting structure 116 can include at least one sloped surface 134. The at least one sloped surface 134 can be defined by an upper surface of at least one sloped projection 136 on the mounting structure 116. As illustrated herein, a plurality of sloped projections 136 are provided on the bottom wall 122 of the mounting structure 116. Specifically, three sloped projections 136 are provided at generally equally-spaced intervals around the conduit 124.

Each sloped projection 136 can include a sloped inner wall 138 and a sloped outer wall 140 positioned outwardly from the inner wall 138. The upper surfaces of the inner and outer walls 138, 140 therefore collectively define the sloped surface 134. The inner and outer walls 138, 140 define a space 142 therebetween.

The inner and outer walls 138, 140 collectively define an incline portion 144, a peak portion 146, and a drop portion 148 of the sloped projection 136. The peak portion 146 includes the highest point of the sloped projection 136, and therefore the highest point of the sloped surface 134, with respect to the bottom wall 122 of the mounting structure 116. The incline and drop portions 144, 148 extend from different sides of the peak portion 146 to join the bottom wall 122. The incline portion 144 can have the same or a different gradient as the drop portion 148. The incline and drop portions 144, 148 are defined by the direction of rotation of the filter housing 86 when latching the dirt cup 22 to the main body 16, as will be described in greater detail below. The sloped projections 136 can be formed as continuous or near continuous lobe-like structures, with the incline and drop portions 144, 148 of adjacent sloped projections 136 meeting or almost meeting each other along the bottom wall 122.

The second sloped portion 132 provided on the filter housing 86 can include at least one sloped surface 150 at a position corresponding to the position of the sloped surface 134 on the mounting structure 116. The at least one sloped surface 150 can be defined by an upper surface of a sloped projection 152 on the filter housing 86. As illustrated herein, a plurality of sloped projections 152 are provided on the bottom wall 90 of the filter housing 86. Specifically, three sloped projections 152 are provided at generally equally-spaced intervals around the outlet opening 98 in the bottom wall 90.

Each sloped projection 152 can include a sloped main wall 154 and one or more cross walls 156 which are formed transverse to the main wall 154. The upper surfaces of the main and cross walls 154, 156 therefore collectively define the sloped surface 150.

The main wall 154 defines an incline portion 158, a peak portion 160, and a drop portion 162 of the sloped projection 152. The peak portion 160 includes the highest point of the sloped projection 152, and therefore the highest point of the sloped surface 150, with respect to the bottom wall 90 of the filter housing 86. The incline and drop portions 158, 162 extend from different sides of the peak portion 160 to join the bottom wall 90. The incline portion 158 can have the same or a different gradient as the drop portion 162. The incline and drop portions 158, 162 are defined by the direction of rotation of the filter housing 86 when latching the dirt cup 22 to the main body 16, as will be described in greater detail below.

The first and second sloped portions 130, 132 can extend in a circumferential direction of the mounting structure 116 and filter housing 86 respectively, such that rotation of the filter housing 86 relative to the mounting structure 116 causes upward and downward movement of the filter housing 86 relative to the mounting structure 116. Specifically, the sloped projections 136 of the first sloped portion 130 can extend in a circumferential direction around the conduit 124 in the bottom wall 122 of the mounting structure 116, and the sloped projections 152 of the second sloped portion 132 extend in a circumferential direction around the outlet opening 98 in the bottom wall 90 of the filter housing 86.

The latch mechanism 128 further includes a position limiter for limiting the movement of the filter housing 86 relative to the mounting structure 116. As illustrated herein, the position limiter comprises a locking pin 164 and a locking pin receiver 166 configured to selectively receive the locking pin 164. As illustrated, the locking pin 164 is provided on the filter housing 86 and projects downwardly from the bottom wall 90. The locking pin receiver 166 is provided on the mounting structure 116 and projects upwardly from the bottom wall 122. The locking pin receiver 166 includes a semi-cylindrical wall 168 defining an inner hollow 170 which is accessible through a slot 172 in the wall 168. The semi-cylindrical wall 168 can be deformable, such that that locking pin 164 is forced through the slot 172 and into the inner hollow 170 to lock the filter housing 86 in a predetermined position with respect to the mounting structure 116. A ramped recessed portion 174 is formed in the bottom wall 90 of the filter housing 86 to provide clearance for the locking pin receiver 166 relative to the filter housing 86 as the filter housing 86 moves with respect to the mounting structure 116.

Other configurations of the position limiter are possible. In one alternate configuration, the locking pin 164 can be provided on the mounting structure 116 and the locking pin receiver 166 can be provided on the filter housing 86. Still other configurations of the position limiter do not rely upon a locking pin/receiver arrangement, but rather use other means for limiting the rotation of the filter housing 86 relative to the mounting structure 116, such as hooks, tabs, detents, etc. In one such configuration, the first and second sloped portions can be provided with corresponding shoulders, wherein the shoulders are configured to bear against one another to limit rotation of the filter housing 86 relative to the mounting structure 116.

The filter housing 86 can further be provided with a handle 176 for facilitating movement of the filter housing 86 relative to the mounting structure 116. The handle 176 can be integrally formed with the filter housing 86 as a projection extending from a portion of the side wall 92. As illustrated, the handle 176 extends from the side wall 92 near the upper edge 94 of the side wall 92.

Figure 6:
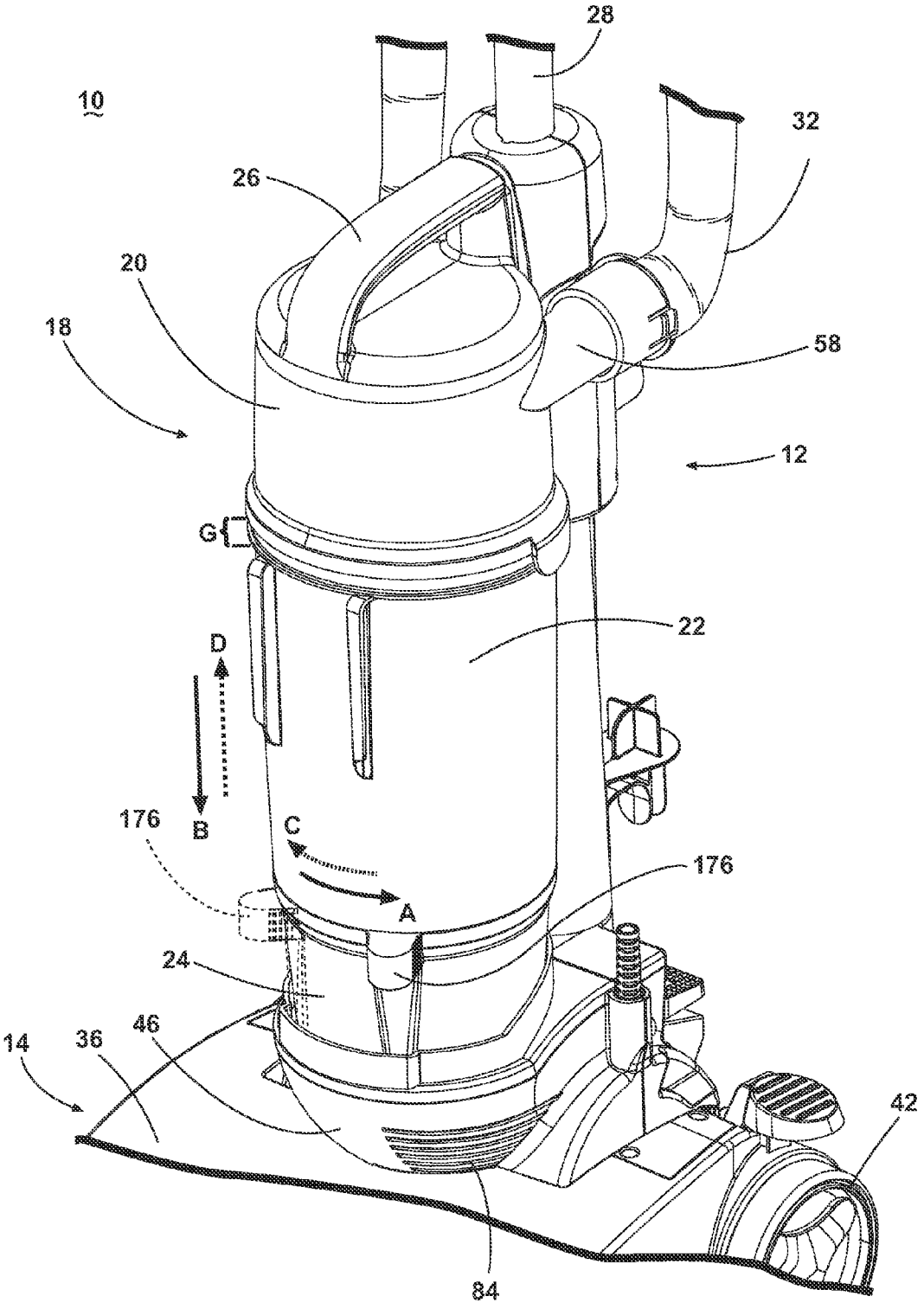
FIG. 6 is a front perspective view of a vacuum cleaner with the latch mechanism in an unlatched position.
Figure 7:
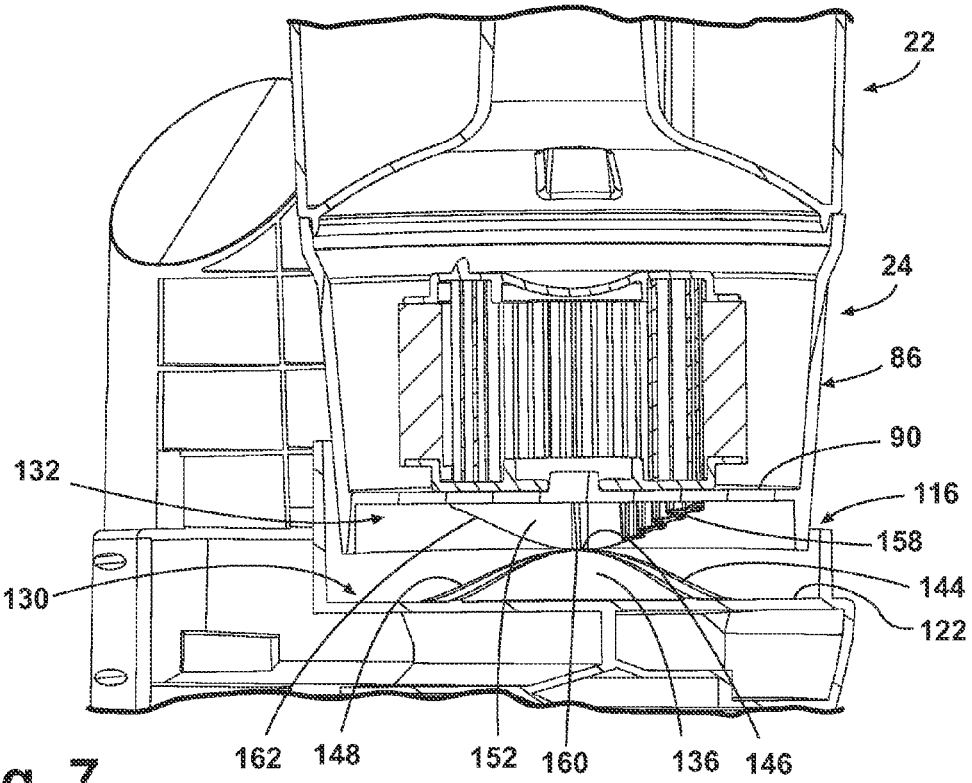
FIG. 7 is a cross-sectional view of the latch mechanism in a latched position.
Figure 8:
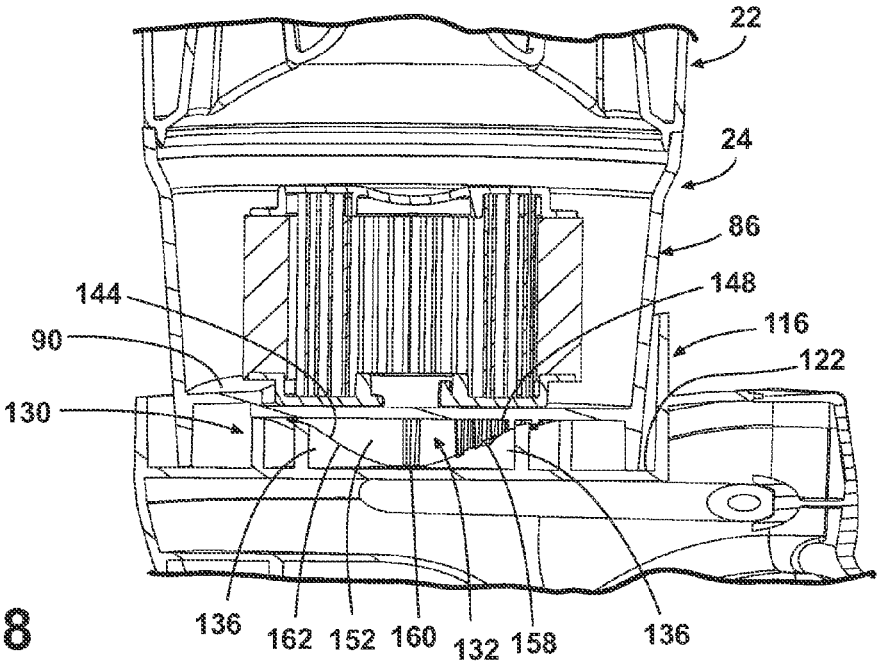
FIG. 8 is a cross-sectional view of the latch mechanism in an unlatched position.

In operation, the latch mechanism 128 is movable between a latched position, shown in FIGS. 1 and 7, in which the dirt cup 22 is secured to the vacuum cleaner 10, and an unlatched position, shown in FIGS. 6 and 8, in which the dirt cup 22 can be removed from the vacuum cleaner 10. In the latched position, both the dirt cup 22 and the filter assembly 24 are received by the mounting structure 116, with the bottom wall of the filter housing 86 resting on the bottom wall 122 of the recess 118 and with the bottom wall 64 of the dirt cup 22 resting on the top edge of the filter housing 86.

To move the latch mechanism 128 from the latched position to the unlatched position, the filter assembly 24 is moved. To do so, the handle 176 or another portion of the filter housing 86 is gripped by a user, and sufficient force is applied to rotate the filter housing 86 in a first direction A relative to the mounting structure 116. As the filter housing 86 rotates in the first direction A, the second sloped portion 132 on the filter housing 86 bears against the first sloped portion 130 of the mounting structure 116, which results in movement of the filter housing 86 in a second direction B, which is transverse to the first direction A, with respect to the mounting structure 116. More specifically, as the first and second sloped portions 130, 132 bear against each other, the drop portion 162 of the sloped projections 152 on the filter housing 86 will ride downwardly along the drop portion 148 of the sloped projections 136 on the mounting structure 116, which lowers the bottom wall 90 of the filter housing 86 toward the bottom wall 122 of the mounting structure 116, and draws the filter housing 86 downwardly within the recess 118 of the mounting structure 116. Since the dirt cup 22 rests upon the filter housing 86, the dirt cup 22 will also be drawn downwardly. The first and second sloped portions 130, 132 continue to bear against each other until the peak portion 160 of the sloped projections 152 on the filter housing 86 reach the valley formed between the incline and drop portions 144, 148 of adjacent sloped projections 136 on the mounting structure 116.

As the filter housing 86 is rotated, the locking pin 164 is moved out of the locking pin receiver 166. The position limiter can be configured such that moving the locking pin 166 out of the locking pin receiver is accompanied by a tactile and/or audible feedback to let the use know that the filter housing 86 is unlocked from the mounting structure 116.

The mounting structure 116 comprises an upper surface of the recess 118, which selectively closes an open top of the dirt cup 22. As such, movement of the filter housing 86 in the second direction A forms a gap G between the upper surface and the dirt cup 22. The upper surface can be defined by a lower surface of the cyclone housing 50, whereby the gap G is formed between the lower edge 54 of the cyclone housing 50 and the upper edge 68 of the dirt cup 22.

To remount the dirt cup 22 to the vacuum cleaner 10, the filter assembly 24 is first seated in the recess of the mounting structure 116. The dirt cup 22 is thereafter seated on top of the filter housing 86. The filter assembly 24 is then moved by gripping the handle 174 or another portion of the filter housing 86 and applying sufficient force to rotate the filter housing 86 in a third direction C, which is opposite the first direction A, relative to the mounting structure 116. As the filter housing 86 rotates in the third direction C, the second sloped portion 132 on the filter housing 86 bear against the first sloped portion 130 of the mounting structure 116, which results in movement of the filter housing 86 in a fourth direction D, which is opposite the second direction B and transverse to the third direction C, with respect to the mounting structure 116. More specifically, as the first and second sloped portions 130, 132 bear against each other, the incline portion 158 of the sloped projections 152 on the filter housing 86 will ride up the incline portion 144 of the sloped projections 136 on the mounting structure 116, which displaces the bottom wall 90 of the filter housing 86 with respect to the bottom wall 122 of the mounting structure 116 and pushes the filter housing 86 upwardly within the mounting structure 116. Since the dirt cup 22 rests upon the filter housing 86, the filter housing 86 will exert a force to the bottom wall 64 of the dirt cup 22 and the dirt cup 22 will also be pushed upwardly. The first and second sloped portions 130, 132 continue to bear against each other until the peak portion 160 of the sloped projections 152 on the filter housing 86 reaches the peak portion 146 of the sloped projections 136 on the mounting structure 116.

As the filter housing 86 is rotated, the locking pin 164 is moved towards the locking pin receiver 166, and will eventually encounter the locking pin receiver 166. Continued force from the user will press the locking pin 164 through the slot 172 and into the inner hollow 170 of the locking pin receiver 166 to lock the filter housing 86 in a predetermined position with respect to the mounting structure 116. The position limiter can be configured such that snapping the locking pin 164 into the locking pin receiver 166 is accompanied by a tactile and/or audible feedback to ensure the user that the filter housing 86 is correctly positioned and locked on the mounting structure 116. The latch mechanism 128 can be configured so that the peak portion 160 of the sloped projections 152 on the filter housing 86 reaches the peak portion 146 of the sloped projections 136 on the mounting structure 116 as the locking pin 164 is received by the locking pin receiver 166.

While not illustrated herein, either of the first or second sloped portions 130, 132 can comprise a sloped recess, rather than a projection 136, 152 extending from the mounting structure 116 or the filter housing 86. For example, the sloped surface 150 of the second sloped portion 132 can be located within a recess in the bottom wall 90 of the filter housing 86. The recess can be configured to at least partially receive the sloped projections 136 of the mounting structure 116. Furthermore, features of the latch mechanism 128 provided on the filter housing 86 can be reversed with features of the latch mechanism 128 provided on the mounting structure 116.

While the invention has been specifically described in connection with certain specific embodiments thereof, it is to be understood that this is by way of illustration and not of limitation, and the scope of the appended claims should be construed as broadly as the prior art will permit. The illustrated vacuum cleaner is but one example of the variety of vacuum cleaners with which this invention or some slight variant can be used. While shown and described for use with an upright vacuum cleaner, the latch mechanism 128 can be used with any type of vacuum cleaner, such as canister vacuum cleaners, robotic vacuum cleaners, hand-held vacuum cleaners, or built-in central vacuum cleaning systems. The latch mechanism 128 can also be used with vacuum cleaners adapted to take up fluids, such as extractors and steam cleaners. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A latch mechanism for selectively fastening a dirt cup to a vacuum cleaner comprising a housing having a mounting structure for mounting a dirt cup and a filter housing, and at least one sloped projection provided on the mounting structure, the latch mechanism comprising:

a filter housing having at least one sloped surface at a position corresponding to the position of the sloped projection on the mounting structure and a top portion configured to support a dirt cup;

wherein movement of the filter housing in a first direction relative to the mounting structure, with the at least one sloped surface bearing against the at least one sloped projection, results in the movement of the filter housing, and thus the dirt cup, in a second direction transverse to the first direction with respect to the mounting structure.

2. The latch mechanism according to claim 1, wherein the at least one sloped projection is located on a bottom wall of the mounting structure and the at least one sloped surface is located within a recess in a bottom wall of the filter housing for accommodating the sloped projection.

3. The latch mechanism according to claim 1, wherein the mounting structure comprises a recess in the housing of the vacuum cleaner.

4. The latch mechanism according to claim 3, wherein both the filter housing and the recess are substantially cylindrical.

5. The latch mechanism according to claim 1, wherein the at least one sloped projection and the at least one sloped surface extend in a circumferential direction of the mounting structure and filter housing respectively, such that rotation of the filter housing relative to the mounting structure along the first direction causes axial movement of the filter housing relative to the mounting structure along the second direction.

6. The latch mechanism according to claim 5, wherein the at least one sloped projection comprises a plurality of sloped projections that are equally spaced around a circumference of the mounting structure and the at least one sloped surface comprises a plurality of sloped surfaces that are spaced evenly around a circumference of the filter housing.

7. The latch mechanism according to claim 6, wherein the plurality of sloped surfaces are defined by the upper surfaces of a plurality of projections formed on the filter housing.

8. The latch mechanism according to claim 1, wherein the mounting structure comprises an upper surface which selectively closes an open top of the dirt cup, wherein the movement of the filter housing in the second direction forms a gap between the upper surface and the dirt cup.

9. The latch mechanism according to claim 1, and further comprising a position limiter for limiting the movement of the filter housing relative to the mounting structure.

10. A vacuum cleaner comprising:

a housing having a mounting structure;

a filter housing selectively mounted in the mounting structure;

a dirt cup selectively mounted in the mounting structure and supported by the filter housing;

a first sloped portion on the mounting structure in supporting relationship to the filter housing; and a second sloped portion on the filter housing corresponding to the first sloped portion;

wherein the first sloped portion and the second sloped portion are configured such that movement of the filter housing in a first direction relative to the mounting structure as the first and second sloped portions bear against each other results in the movement of the filter housing, and thus the dirt cup, in a second direction transverse to the first direction relative to the mounting structure.

11. The vacuum cleaner according to claim 10, wherein the first sloped portion comprises at least one sloped projection and the second sloped portion comprises at least one sloped surface.

12. The vacuum cleaner according to claim 11, wherein the at least one sloped projection is located on a bottom wall of the mounting structure and the at least one sloped surface is located on a bottom wall of the filter housing for accommodating the sloped projection.

13. The vacuum cleaner according to claim 10, wherein the mounting structure comprises a recess in the housing of the vacuum cleaner.

14. The vacuum cleaner according to claim 13, wherein both the filter housing and the recess are substantially cylindrical.

15. The vacuum cleaner according to claim 10, wherein the first and second sloped portions extend in a circumferential direction of the mounting structure and filter housing respectively, such that rotation of the filter housing relative to the mounting structure along the first direction causes axial movement of the filter housing relative to the mounting structure along the second direction.

16. The vacuum cleaner according to claim 10, wherein the first sloped portion comprises a plurality of sloped projections that are equally spaced around a circumference of the mounting structure and the second sloped portion comprises a plurality of sloped surfaces that are spaced evenly around a circumference of the filter housing.

17. The vacuum cleaner according to claim 10, wherein the mounting structure comprises an upper surface which selectively closes an open top of the dirt cup, wherein the movement of the filter housing in the second direction forms a gap between the upper surface and the dirt cup.

18. The vacuum cleaner according to claim 17, and further comprising a cyclone housing, wherein the upper surface is defined by a lower surface of the cyclone housing.

19. The vacuum cleaner according to claim 10, and further comprising a position limiter for limiting the movement of the filter housing relative to the mounting structure.

20. The vacuum cleaner according to claim 19, wherein the position limiter comprises a locking pin provided on one of the filter housing and the mounting structure and a locking pin receiver provided on the other of the filter housing and the mounting structure.

* * * * *